United States Patent [19]

Den Bleyker

[11] Patent Number: 4,541,493

[45] Date of Patent: Sep. 17, 1985

[54] BULLDOZER TILT MECHANISM

[75] Inventor: Joseph R. Den Bleyker, Stevensville, Mich.

[73] Assignee: Clark Equipment Company, Buchanan, Mich.

[21] Appl. No.: 625,480

[22] Filed: Jun. 28, 1984

[51] Int. Cl.[4] ..... A01B 3/76

[52] U.S. Cl. ..... 172/824

[58] Field of Search ..... 172/824, 827, 821, 825, 172/826, 822; 180/41, 9.5, 9.52

[56] References Cited

U.S. PATENT DOCUMENTS

| | | | |
|---|---|---|---|
| 1,991,781 | 2/1935 | Bird | 172/824 |
| 2,837,845 | 6/1958 | Armington | 37/144 |
| 3,018,573 | 1/1962 | McAdams | 172/824 |
| 3,117,647 | 1/1964 | Polko | 180/41 X |
| 3,487,884 | 1/1970 | Volberding | 172/803 |
| 3,653,451 | 4/1972 | Fryrear | 172/824 |
| 3,698,490 | 10/1972 | King | 172/824 |
| 4,019,588 | 4/1977 | Casey | 172/804 |

FOREIGN PATENT DOCUMENTS

| | | | |
|---|---|---|---|
| 623417 | 7/1961 | Canada | 172/824 |

*Primary Examiner*—Richard J. Johnson

*Attorney, Agent, or Firm*—Kenneth C. Witt; John C. Wiessler

[57] ABSTRACT

A tilt mechanism for a bulldozer blade which includes pivotally mounted trunnion members projecting outwardly on both sides of the main frame of the vehicle. A tilt beam is pivotally connected at its extremities between the two trunnion members, and a hydraulic cylinder is pivotally connected between the main frame and one of the trunnion members for selectively tilting the bulldozer blade in unison with movement of the tilt beam and the trunnion members.

3 Claims, 5 Drawing Figures

BULLDOZER TILT MECHANISM

BACKGROUND OF THE INVENTION

1. Field of the Disclosure

This invention relates to a tilt mechanism for the blade of a bulldozer vehicle.

2. Description of the Prior Art

U.S. Pat. No. 2,837,845 Armington shows a tilt mechanism for a bulldozer blade which includes a transverse tilt beam without any trunnion members, and a longitudinally extending tilt cylinder arranged to move one end of the tilt beam up and down to accomplish tilting of the bulldozer blade.

U.S. Pat. No. 3,487,884 Volberding shows a bulldozer assembly for a tractor which includes a pair of longitudinal push arms along the sides of the tractor attached to a bulldozer blade at the bottom of a pair of vertical blade standards on the back of the blade, a pair of operating arms pivotally attached to the top end of the blade standards, the operating arms being connected at the rearward ends to a transverse rock shaft and further connected to a rock shaft arm which controls the action of the blade hydraulically. Also provided are means disposed between the blade standards, push arms and operating arms to control tilting of the blade, the tilting means comprising a pair of plates in face-to-face relationship which are pivoted at one corner and provided with hydraulically operated lever means to cause the blade to tilt.

U.S. Pat. No. 4,019,588 Casey shows a bulldozer blade tilting mechanism which comprises a pair of laterally spaced push arms pivotally interconnected between a blade and the frame of the vehicle. A pair of lift cylinders are pivotally connected between the frame and the blade for selectively raising or lowering the blade relative to the frame. A tilt mechanism for tilting the normally upright blade about a longitudinal axis includes triangular members pivotally connected between the frame and the blade. A double acting cylinder is pivotally interconnected between the apices of the triangular members for selectively pivoting such members relative to each other to tilt the blade.

SUMMARY OF THE INVENTION

This invention is a tilt mechanism for a bulldozer blade which includes a pair of pivotally mounted trunnion members projecting outwardly on opposite sides of the main frame of the vehicle. A tilt beam is pivotally connected at its extremities between the two trunnion members, and a hydraulic cylinder is pivotally connected between the main frame and one of the trunnion members. The tilt beam is connected by push beams to the bulldozer blade. Tilting in this context means pivoting a bulldozer blade so that one lateral extremity is lower than the other extremity.

BRIEF DESCRIPTION OF THE PREFERRED EMBODIMENT

Figure 3A:
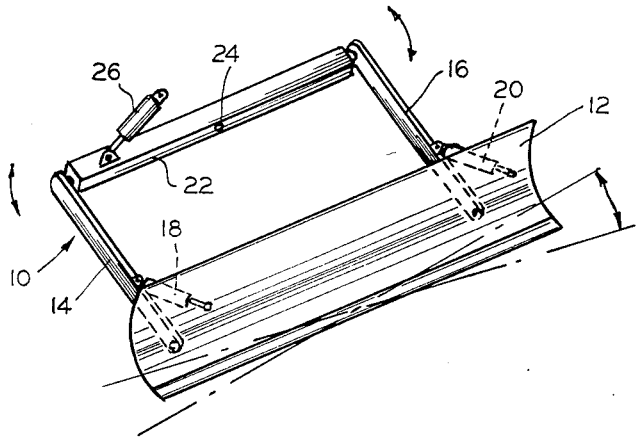
FIG. 3A (PRIOR ART)
FIGS. 3A, 3B and 3C are diagrams which illustrate three prior art constructions.

Referring first to FIG. 3A of the drawing there is shown a prior art tilt mechanism indicated generally at 10 for a blade 12. The blade 12 is pivotally mounted at the front ends of push beams 14 and 16, and the pitch of the blade is adjusted by means of pitch cylinders 18 and 20. The rearward ends of the push beams 14 and 16 are pivotally mounted at the outer extremities respectively of a tilt beam 22 which is pivotally mounted at its center 24 on the main frame of the vehicle. The blade 12 is tilted by means of a hydraulic tilt cylinder 26 which is connected between the beam 22 and the main frame of the vehicle. As the cylinder 26 is extended the adjacent end of the tilt beam moves downwardly and the far end of the beam moves upwardly, and when the cylinder 26 is retracted the adjacent end of the beam moves upwardly and the far end of the beam moves downwardly.

Figure 3B:
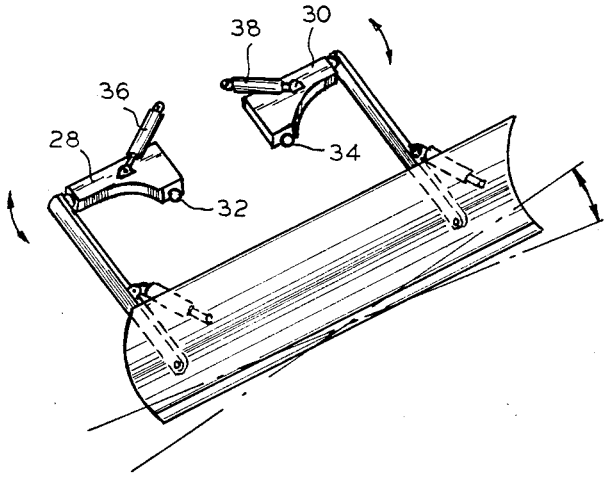
FIG. 3B (PRIOR ART)

FIG. 3B shows another prior art construction which has two trunnion members 28 and 30 which are pivotally mounted about longitudinal axes 32 and 34. A tilt cylinder 36 is connected between the main frame of the vehicle and trunnion 28 while another tilt cylinder 38 is connected between the main frame and trunnion 30. With individual control of the two trunnions one can be tilted downwardly as the other is being tilted upwardly and vice versa whereby it is possible to secure a considerable range of tilting and more than the construction shown in FIG. 3A.

Figure 3C:
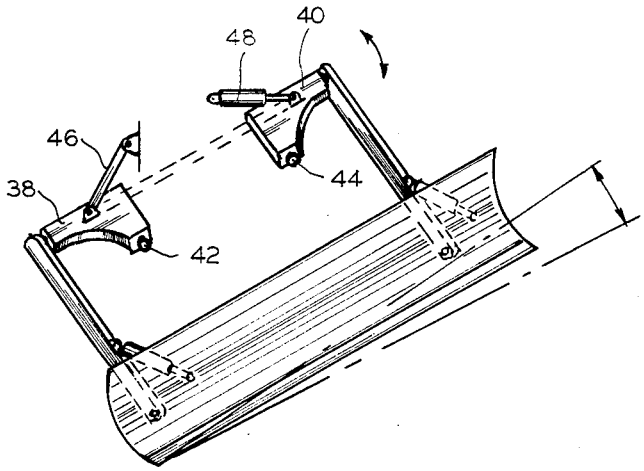
FIG. 3C (PRIOR ART)

FIG. 3C shows another tilt mechanism which includes trunnions 38 and 40 pivotally mounted on the main frame about axes 42 and 44 respectively. A fixed strut 46 is connected between the main frame of the vehicle and trunnion 38. A double acting hydraulic cylinder 48 is connected between the main frame and trunnion member 40 on the opposite side of the machine. With this arrangement, it is possible to tilt the blade by extending or retracting hydraulic cylinder 48, but using similar size components the total arcuate travel is less than the mechanism of 3B.

Figure 1:
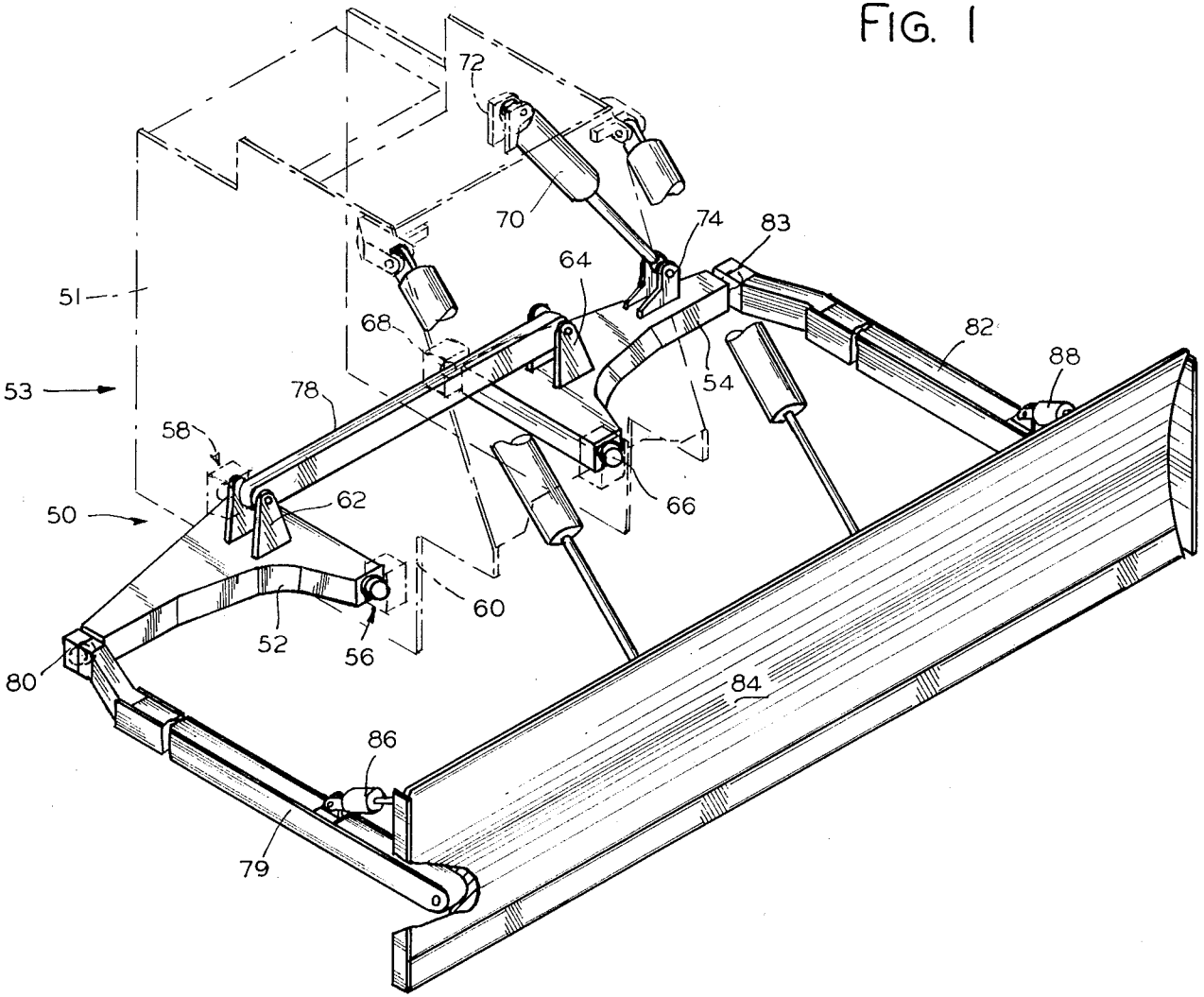
FIG. 1 is a perspective view of a tilt mechanism according to this invention with many parts of the bulldozer omitted for clarity.

Referring to FIG. 1 of the drawing the numeral 50 indicates generally a tilt mechanism embodying the present invention and 51 denotes the main frame of a vehicle 53. Included in the mechanism 50 are a pair of outwardly projecting trunnion members 52 and 54 respectively which are pivotally mounted on opposite sides of the frame 51 by pivot connections 56,58 on one side and 66,68 on the other side. Connections 56 and 58 connect the trunnion member 52 on one side to the main frame to pivot about a longitudinal axis extending through connections 56 and 58. Pivot connections 66, and 68 connect the trunnion member 54 on the other side to the main frame of the vehicle to pivot about a longitudinal axis extending through connections 66 and 68. A bracket 62 is integrally mounted on the upper surface of trunnion member 52. On the other side of the vehicle a bracket 64 is integrally mounted on trunnion 54. A tilt beam 78 is pivotally connected between brackets 62 and 64. A double-acting hydraulic cylinder 70 extends between bracket 72 which is integrally mounted on the frame 51 of the machine, and bracket 74 which is integrally mounted on trunnion member 54.

A push beam 79 is pivotally connected at 80 at the outer extremity of trunnion member 52. A second push beam 82 is pivotally connected at 83 at the outer extremity of trunnion 54. At the front extremities of push beams 79 and 82 a blade 84 is mounted, and typically this blade is arranged for pitch adjustment by means of a pair of hydraulic cylinders 86 and 88 respectively which are connected between the respective push beams and the blade. The push beams may be a part of a C-shaped frame which includes a bight portion on which the blade is mounted.

In the operation of this invention if it is desired to tilt the blade mechanism so as to raise the right hand portion, as seen by an observer facing the front of the vehicle, and lower the left hand portion, hydraulic cylinder 70 is retracted. This pivots trunnion 54 upwardly and beam 78 pushes trunnion 52 downwardly. Thus a single cylinder produces upward movement on one side of the mechanism and downward movement on the other side, the extent of the two movements being equal if the respective pivot axes of tilt beam 78 are equidistant from the two trunnion pivot axes. It is possible to have such radii different if desired in order to achieve unequal pivoting on opposite sides of the vehicle.

Figure 2:
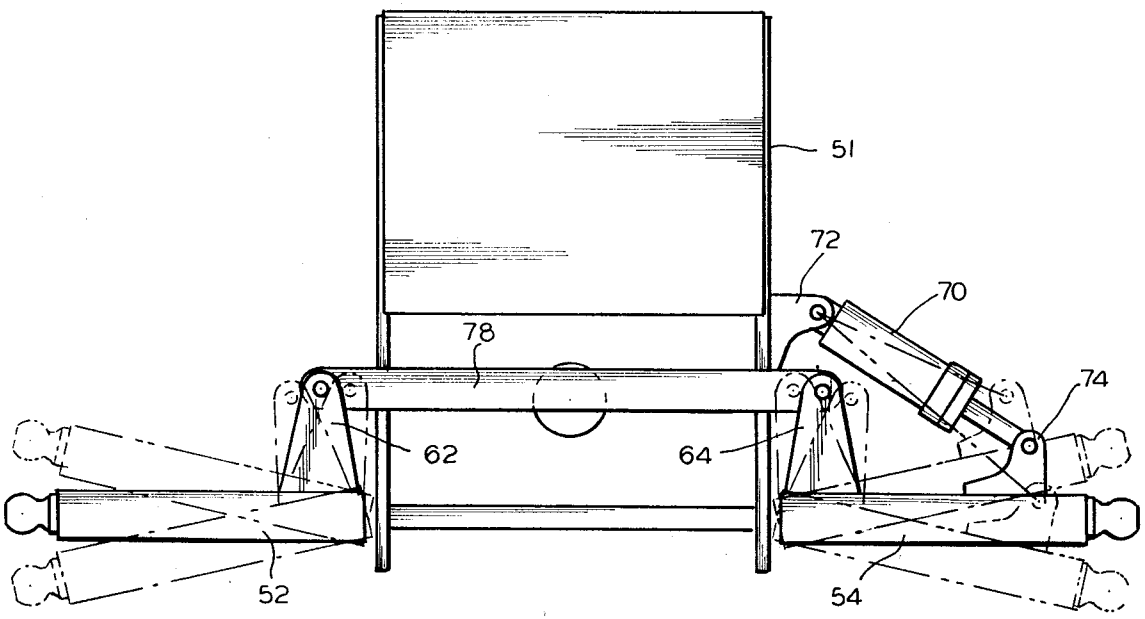
FIG. 2 is an outline view in elevation of the tilt mechanism illustrating the median position and the maximum tilt positions in both directions.

To facilitate an understanding of the operation of the tilt mechanism 50 there is shown in FIG. 2 of the drawing a diagram in solid lines which shows the tilt mechanism in the neutral position. Dashed lines show two other positions, one in each direction which illustrate the respective extreme tilted positions. It will be appreciated that the blade 84 tilts in unison with tilt beam 78 whereby the blade tilts through the same angles as the tilt beam.

This invention provides considerably more blade tilting action than the prior art if comparable components are used.

"Cylinder" or "hydraulic cylinder" as used herein means a double acting linear hydraulic motor comprising an outer barrel portion with both ends closed and an internal piston forming variable volume chambers between the piston and the respective ends of the barrel portion. The piston is mounted on a rod which projects through the closure at one end of the barrel portion.

While I have described and illustrated herein a preferred embodiment of my invention illustrating the best mode contemplated for carrying out the invention, it will be understood by those skilled in the art that modifications may be made. I intend to cover by the appended claims all such modifications which fall within the true spirit and scope of my invention.

I claim:

1. A bulldozer having a main frame, a pair of trunnion members pivotally mounted on the main frame about longitudinal axes and projecting outwardly on opposite sides of the main frame, a pair of push beams connected at the outer ends of the trunnion members and extending forwardly, and a blade supported by the push beams, comprising a tilt beam pivotally connected at its extremities between the said two trunnion members, and a hydraulic cylinder pivotally connected between said main frame and one of said trunnion members, whereby operation of said hydraullic cylinder to extend it causes one trunnion member to pivot downwardly and the other upwardly and said blade to tilt in unison, and operation of said hydraulic cylinder to retract it causes said one trunnion member to pivot upwardly and the other downwardly and said blade to tilt in unison.

2. A bulldozer as in claim 1 wherein the pivot axis of the connection of said hydraulic cylinder to said one trunnion member is farther away from the pivot axis of said one trunnion with said main frame than is the pivot axis of the connection of said tilt beam with said one trunnion member.

3. A bulldozer as in claim 1 wherein the connections of said tilt beam with said trunnion members are symmetrical about the vertical central plane of the bulldozer.

* * * * *